US005944142A

United States Patent [19]

Milner

[11] Patent Number: 5,944,142

[45] Date of Patent: Aug. 31, 1999

[54] APPARATUS FOR ELEVATING A STEPLADDER

[76] Inventor: Robert W. Milner, 440 Sand Creek Rd., Brentwood, Calif. 94513-2052

[21] Appl. No.: 09/141,661

[22] Filed: Aug. 28, 1998

[51] Int. Cl.[6] ..... E06C 1/00

[52] U.S. Cl. ..... 182/203; 182/202

[58] Field of Search ..... 182/200–204, 182/207–211, 141, 186.6, 180.7, 186.3, 22, 23

[56] References Cited

U.S. PATENT DOCUMENTS

| | | | |
|---|---|---|---|
| 973,509 | 10/1910 | Ison . | |
| 2,542,398 | 2/1951 | Crumpton | 182/209 |
| 2,783,928 | 3/1957 | Cox . | |
| 4,984,655 | 1/1991 | Scherer et al. . | |
| 5,174,412 | 12/1992 | Vega . | |
| 5,507,364 | 4/1996 | Spevak | 182/200 |
| 5,553,963 | 9/1996 | Hoy et al. . | |
| 5,609,222 | 3/1997 | Horbacewicz et al. . | |

*Primary Examiner*—Daniel P. Stodola
*Assistant Examiner*—Hugh B. Thompson
*Attorney, Agent, or Firm*—Thomas R. Lampe

[57] ABSTRACT

Stepladder support apparatus for use with a stepladder to allow the stepladder to be positioned on an uneven surface and maintain the rung side of the stepladder at an elevated position includes a support member having a top end and a bottom end. Rung engagement members are attached to the support member for engaging and supporting one or more rungs of the stepladder. The bottom end of the support member extends below the lower end of the rung side of the stepladder when the rung engagement members engage and support a rung or rungs of the stepladder.

10 Claims, 4 Drawing Sheets

APPARATUS FOR ELEVATING A STEPLADDER

TECHNICAL FIELD

This invention relates to apparatus for use with a stepladder to support and elevate the rung side of the stepladder. The apparatus is particularly useful to level the rung side of the stepladder relative to the step side thereof when the stepladder is to be positioned on surfaces of differing elevations, for example on stair steps.

BACKGROUND OF THE INVENTION

It is well known in the prior art to employ extension devices in association with ladders incorporating two side rails. Typically, the extension device is connected to one of the rails and is employed to level the side rails of the ladder when the ladder is utilized on an uneven surface. Examples of such arrangements are shown in the following United States Patents: U.S. Pat. No. 2,783,928, issued Mar. 5, 1957, U.S. Pat. No. 5,507,364, issued Apr. 16, 1996, U.S. Pat. No. 5,553,963, issued Sep. 10, 1996, U.S. Pat. No. 973,509, issued Oct. 25, 1910, U.S. Pat. No. 5,609,222, issued Mar. 11, 1997, U.S. Pat. No. 5,174,412, issued Dec. 29, 1992, and U.S. Pat. No. 4,984,655, issued Jan. 15, 1991.

As mentioned above, such devices are employed to level conventional ladders incorporating two side rails by adjusting the side-to-side orientation of the ladder to accommodate different support levels such as changes in ground height. The devices disclosed in the above-identified patents are not employed with stepladders to maintain the rung side of the stepladder at substantially the same elevation as the step side thereof when the step side is located on a surface that is elevated relative to the surface which will support the rung side of the stepladder. Furthermore, many prior art approaches are characterized by their relative complexity, high expense and difficulty of adjustment and use.

DISCLOSURE OF INVENTION

The present invention relates to apparatus which efficiently and effectively supports the rung side of a stepladder to elevate it relative to a support surface to maintain the rung sides and step sides of the stepladder at substantially the same level.

The stepladder support apparatus of the present invention is for engaging and supporting at least one rung of the stepladder. The bottom end of the support member extends below the lower end of the rung side of the stepladder when the rung engagement means engages and supports at least one rung of the stepladder.

Locking means is employed for locking the rung engagement means to the rung engaged thereby.

Other features, advantages, and objects of the present invention will become apparent with reference to the following description and accompanying drawings.

BEST MODE FOR CARRYING OUT THE INVENTION

Figure 1:
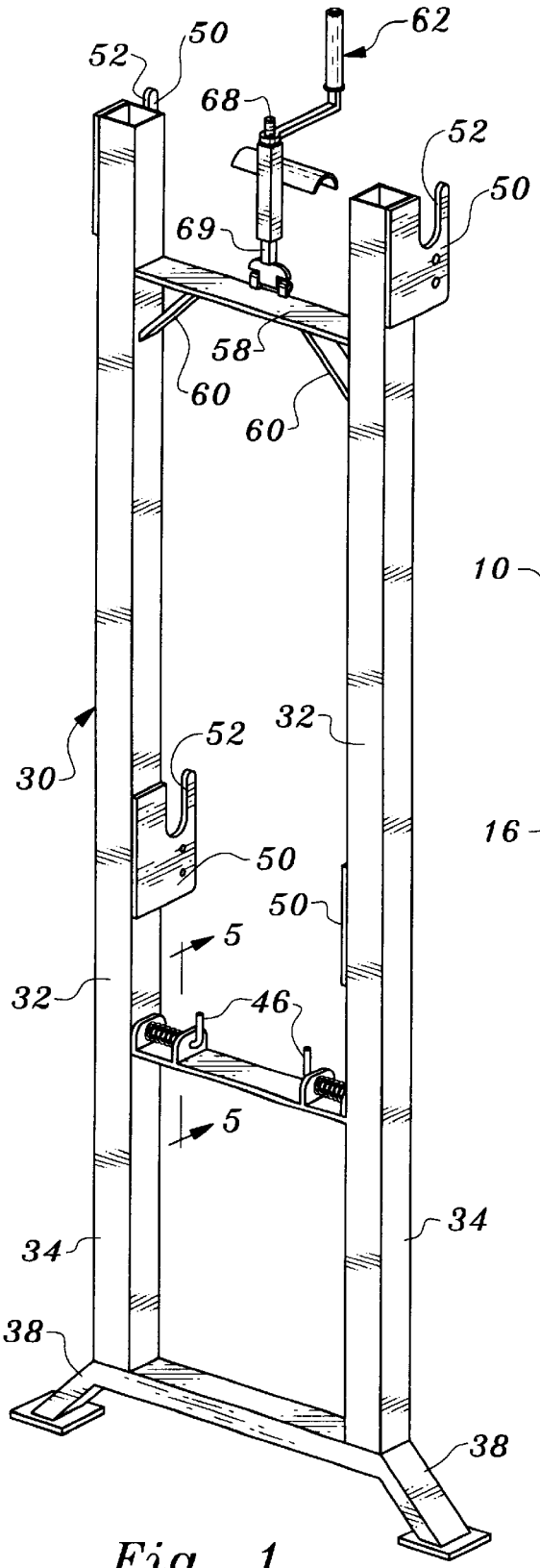
FIG. 1 is a perspective view of stepladder support apparatus constructed in accordance with the teachings of the present invention with support member side portions thereof telescoped.

Referring now to the drawings, stepladder support apparatus constructed in accordance with the teachings of the present invention is for use with a stepladder 10 of conventional construction. The stepladder has a rung side 12 and a step side 14. The rung side has a lower end and includes rails 16. Rungs 18 extend between the rails 16 in a conventional manner. Step side 14 includes rails 20 with steps (not shown) extending therebetween, also in a conventional manner.

Figures 3, 4:
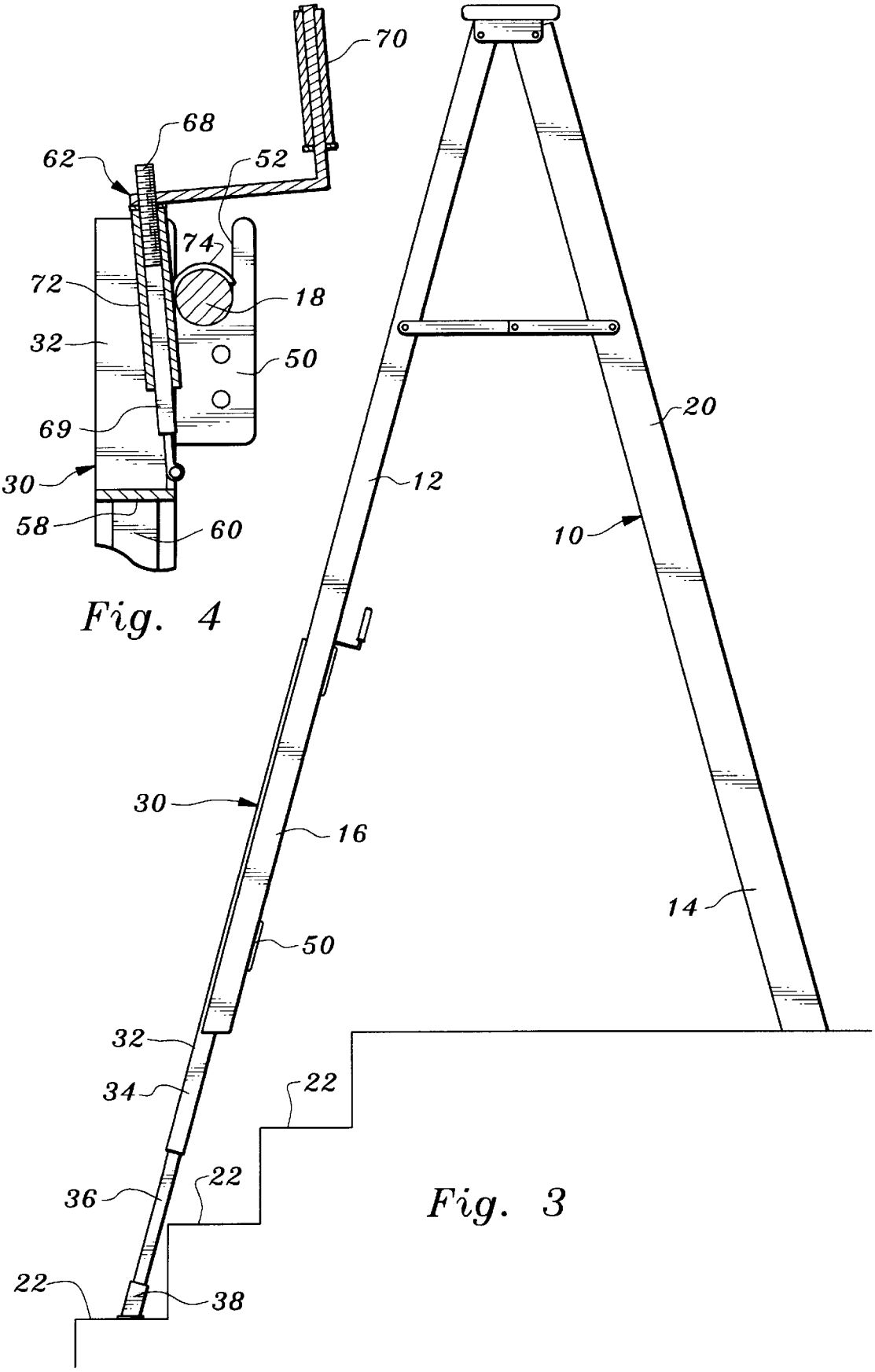
FIG. 3 is a side view of a stepladder with the apparatus of the present invention attached thereto and supporting and maintaining the rung side of the stepladder to maintain the rung side at substantially the same level as the step side despite the fact that the rung side is located over a descending flight of steps.
FIG. 4 is an enlarged cross-sectional view taken along the line 4—4 of FIG. 2.

FIG. 3 shows stepladder 10 with the step side 14 thereof positioned on a landing while the rung side 12 of the stepladder is positioned over a descending flight of steps 22. It will be appreciated that the stepladder would tilt severely in the direction of the rung side and lose its stability if the bottom end of the rung side were placed in direct engagement with one of the steps 22.

It is the purpose of the invention disclosed and claimed herein to elevate and support the rung side of the stepladder so that the stepladder does not tilt from front to back and is maintained in a stable condition so that an individual can climb the stepladder without risking injury.

The apparatus of the present invention includes a support member 30 having a top end and a bottom end. Support member 30 includes a pair of support member sides 32 spaced from one another. Each support member side includes support member side portions 34, 36 telescopically mounted with respect to one another to vary the effective length of the support member. More particularly, in each support member side support member side portion 36 is slidably movable in larger support member side portion 34.

The bottom end of the support member 30 is in the form of two spaced legs 38 fixedly attached to each other and to support member side portions 36.

Figure 5:
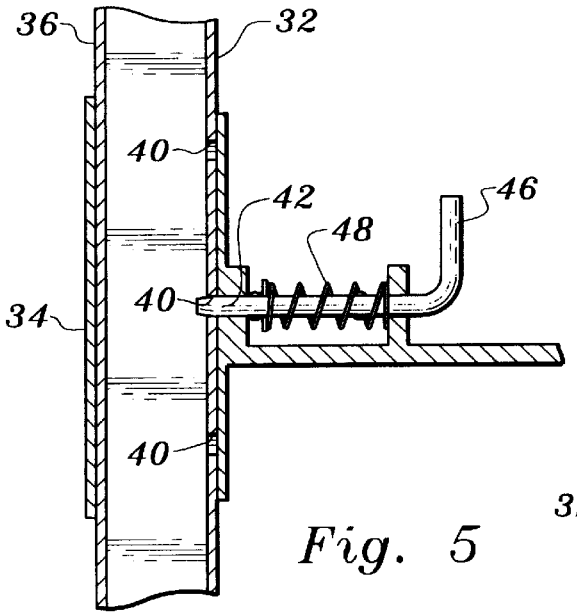
FIG. 5 is a greatly enlarged cross-sectional view taken along the line 5—5 in FIG. 1 and illustrating a lock pin employed in the apparatus maintaining support member side portions of the apparatus against relative movement.
Figure 6:
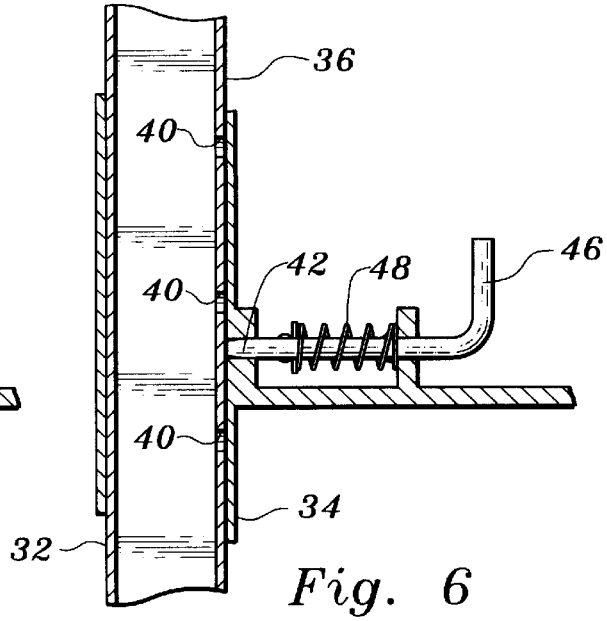
FIG. 6 is a view similar to FIG. 5 but illustrating the lock pin in a retracted position allowing relative movement between the support member side portions.

Each support member side portion 36 has a plurality of openings 40 therein (see FIGS. 5 and 6). An opening 42 is formed in each of the support member side portions 34. Sliding movement of portion 36 relative to portion 34 will serially bring opening 42 into registration with the openings 40.

A pull pin 46 is mounted on a cross brace of support member 30 in association with each of the support member sides. Each pin 46 is positionable in an opening 42. A spring 48 associated with each pull pin biases the pin in the direction of its associated support member side portion 36 so that the distal end of the pin will enter an opening 40 brought into registration with opening 42 to maintain the desired degree of extension. FIG. 5 shows a pin 46 in both openings 40 and 42 to prevent relative slidable movement between the support member side portions. FIG. 6 shows the pin in its manually retracted position which will allow relative sliding between the support member side portions.

Attached to support member sides 32 are pairs of rung engagement members 50, which in the arrangement illustrated are permanently secured as by means of welding, for example, to the support member sides. The top pair of spaced rung engagement members 50 are attached to the outwardly disposed surfaces of the support member sides while the lower pair of spaced rung engagement members 50 are attached to the inner surfaces thereof.

Figure 2:
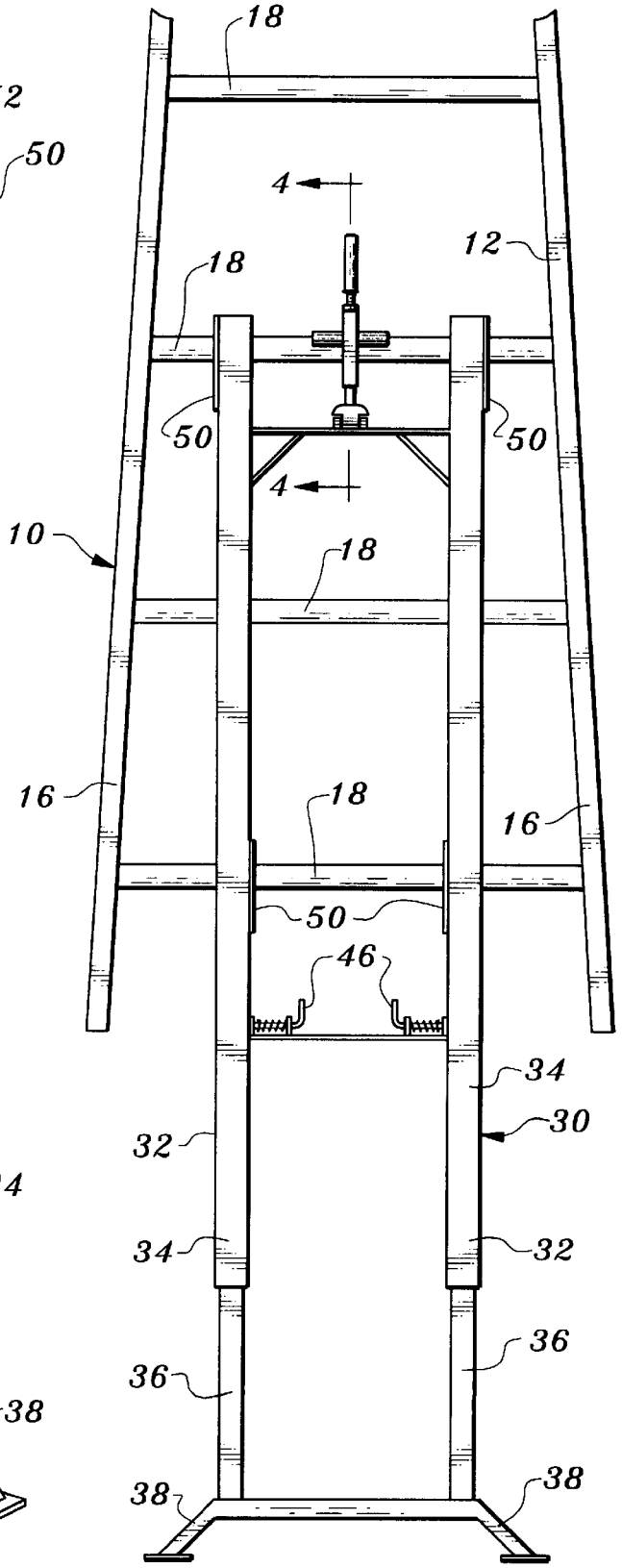
FIG. 2 is a front elevational view of the apparatus being employed to support the rung side of a stepladder, support member side portions of the apparatus being shown locked in extended position.
Figure 7:
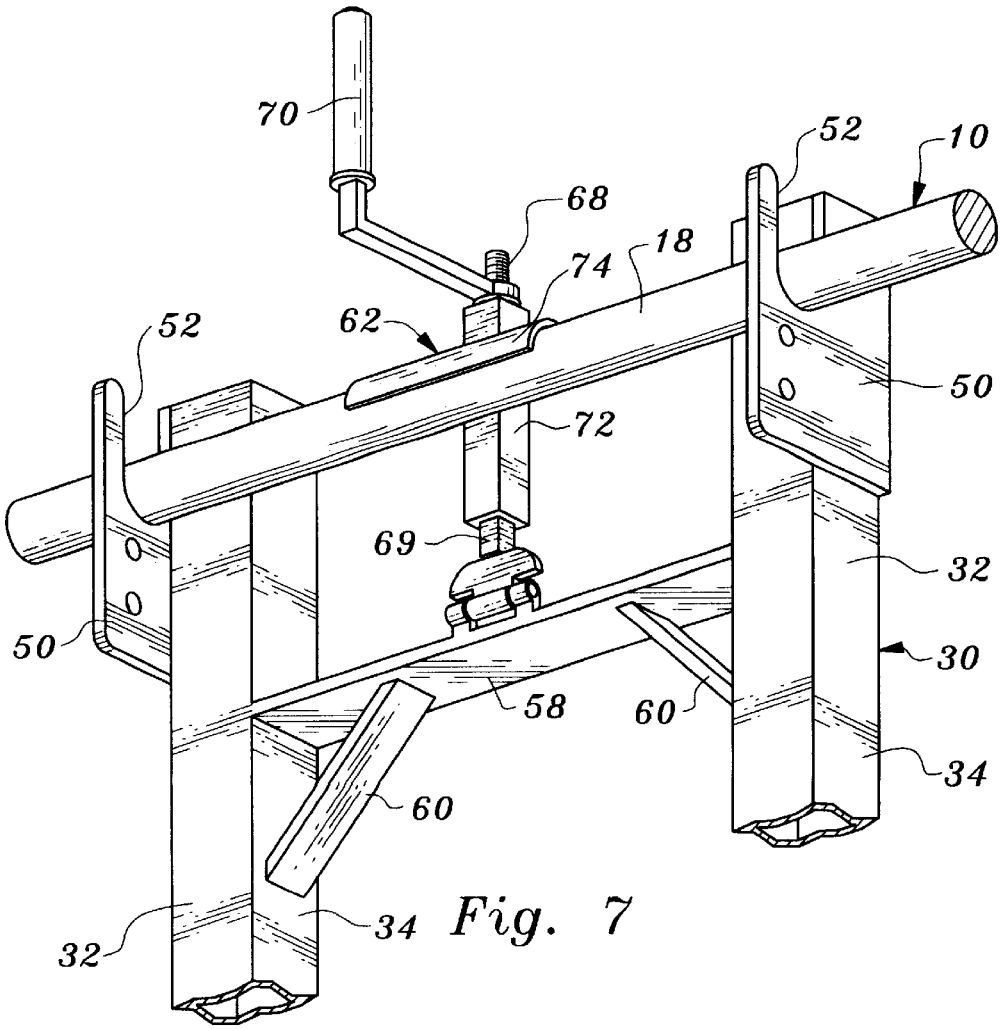
FIG. 7 is a detail view of a stepladder rung being held in place in recesses of two spaced rung engagement members by an adjustable locking clamp.

Each rung engagement member 50 defines an upwardly directed recess 52 which is for receiving a rung 18 of stepladder 10. See, for example, FIGS. 2, 4 and 7.

A cross bar or element 58 braced by braces 60 extends between support member sides 32 and supports an adjustable clamp 62 which is utilized to lock the rungs 18 received in the recesses 52 of rung engagement members 50 in position and prevent upward movement thereof relative to the rung engagement members.

More specifically, clamp 62 includes a shaft 68 round and threaded at the top and having a base 69 with a rectangular cross-section. An actuator handle 70 is threadedly connected to the threaded end of shaft 68 and rotation of the handle 70 about the shaft will cause the handle to move up or down depending upon the direction of rotation. A sleeve 72 having a rectangular cross-section having a rung engagement element 74 affixed thereto is slidably mounted over the base of shaft 68 and is driven downwardly by the handle when the handle is rotated in a direction moving the handle downwardly relative to the shaft. This places element 74 into tight engagement with the rung 18 to clamp the rung in place between element 74 and rung engagement member 50.

Figure 8:
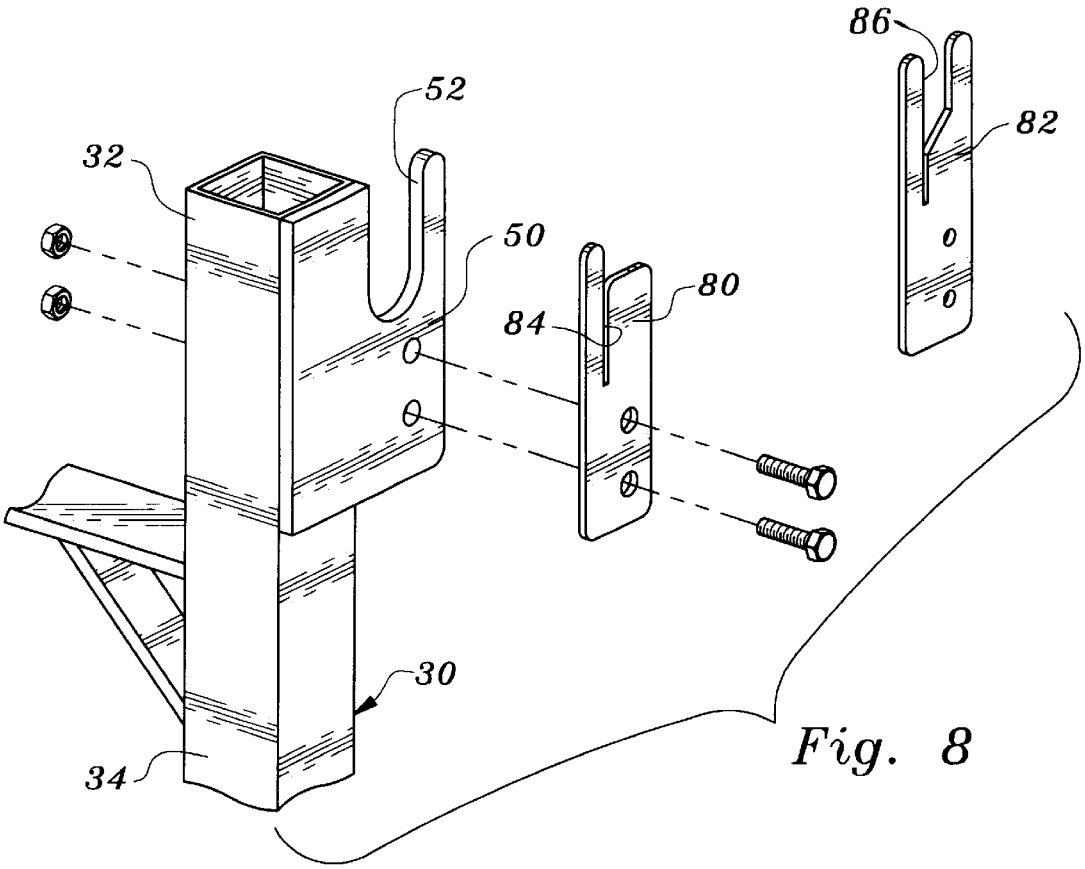
FIG. 8 is a perspective view illustrating a portion of the stepladder support apparatus including a rung engagement member and two adaptor plates which may be secured to the rung engagement member to adapt the rung engagement member for use with rungs having differing configurations.
Figure 9:
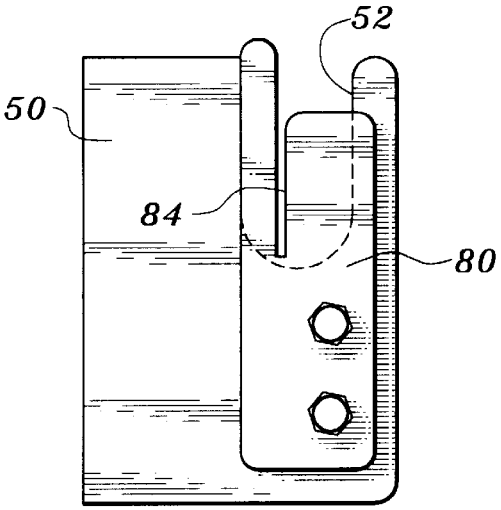
FIG. 9 is a side view showing one of the adaptor plates attached to the rung engagement member.
Figure 10:
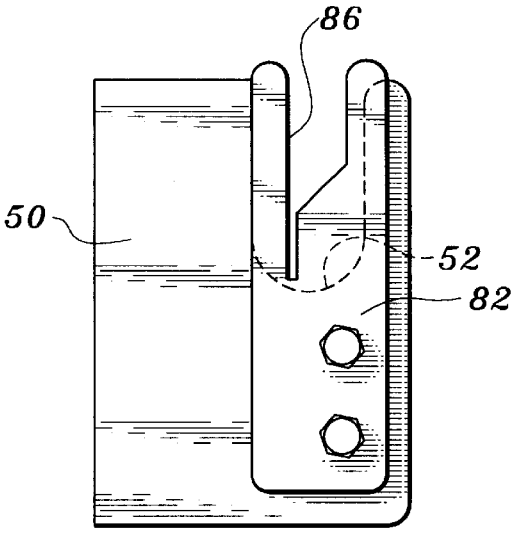
FIG. 10 is a view similar to FIG. 9 but illustrating the other adaptor plate attached to the rung engagement member.

The shape of the recess of each rung engagement member 50 may be modified to accommodate rungs of different types. The structure for accomplishing this is shown in FIGS. 8–10. Adaptor members or plates 80 and 82 may be selectively secured in place on member 50 by means of nuts and bolts, as shown. Adaptor plate 80 has a recess 84 of one configuration differing from recess 52 while adaptor plate 82 has a recess 86 with a configuration differing from those of both recesses 52 and 84. It will be appreciated that recesses 84, 86 are of a shape to receive rungs of different configurations.

FIG. 9 shows adaptor plate 80 secured to a member 50 with recess 84 in partial registry with recess 52. FIG. 10 shows adaptor plate 82 secured in position with recess 86 thereof in partial registry with recess 52 of a member 50.

I claim:

1. Stepladder support apparatus for use with a stepladder having a rung side with a lower end and including at least one rung extending between rails of a first set of rails and a step side including steps extending between rails of a second set of rails, said stepladder support apparatus for supporting the rung side with the lower end thereof in an elevated position to level the stepladder in a front to back direction and comprising, in combination:

a support member having a top end and a bottom end and including a pair of support member sides spaced from one another;

rung engagement means attached to said support member for engaging and supporting at least one rung of a stepladder, said bottom end of said support member extending below the lower end of the rung side of the stepladder when said rung engagement means engages and supports at least one rung of the stepladder, said rung engagement means comprising at least one pair of rung engagement members, said rung engagement members being spaced from one another, located at different support member sides and affixed thereto, each said rung engagement member projecting from said support member and defining an upwardly open recess for releasably receiving a rung; and locking means for locking said rung engagement means to the at least one rung engaged thereby, said locking means comprising an adjustable clamp member connected to said support member for positioning over and in engagement with a rung to be received in the upwardly open recesses of said rung engagement members to exert a downwardly directed force on the rung and releasably lock said rung in said upwardly open recesses.

2. The stepladder support apparatus according to claim 1 wherein said rung engagement means comprises at least two pairs of rung engagement members, said rung engagement members of each pair of rung engagement members being spaced from one another and said pairs of rung engagement members disposed at different locations along said support member and at different distances from the bottom end of the support member.

3. The stepladder support apparatus according to claim 1 wherein said support member includes a cross element extending between said support member sides, said adjustable clamp member being connected to said cross element and extending upwardly therefrom.

4. The stepladder support apparatus according to claim 1 wherein each of said support member sides comprises a plurality of support member side portions telescopically mounted with respect to one another to vary the effective length of said support member.

5. The stepladder support apparatus according to claim 4 including lock means operatively associated with said support member side portions for selectively locking said support member side portions against telescopic movement.

6. The stepladder support apparatus according to claim 5 wherein said support member side portions define selectively registrable openings, said lock means for selectively locking said support member side portions comprising a pin assembly positionable in registered openings of said support member side portions.

7. The stepladder support apparatus according to claim 6 wherein said pin assembly comprises a spring-biased pull pin operatively associated with the support member side portions of each support member side.

8. The stepladder support apparatus according to claim 1 additionally comprising rigid means for modifying the shape of said recess upwardly open.

9. The stepladder support apparatus according to claim 8 wherein said means for modifying the shape of said upwardly open recess includes at least one rigid adaptor member releasably attachable to each of said rung engagement members and defining an upwardly open adaptor member recess differing in shape from the recesses defined by said rung engagement members.

10. The stepladder support apparatus according to claim 9 Wherein said means for modifying the shape of said upwardly open recess includes a plurality of interchangeable rigid adaptor members selectively releasably attachable to each of said rung engagement members and having upwardly open adaptor member recesses of different configurations to receive rungs of differing configurations.

* * * * *